US006454638B2

(12) United States Patent
Bonachera et al.

(10) Patent No.: US 6,454,638 B2
(45) Date of Patent: Sep. 24, 2002

(54) MACHINE FOR GRINDING CYLINDRICAL BEARING SURFACES ON PARTS USING AN ABRASIVE BELT

(75) Inventors: Richard Bonachera, Vincennes; Raymond Millot, Saint Yon, both of (FR)

(73) Assignee: Societe des Procedes et Machines Speciales, Courcouronnes (FR)

( * ) Notice: Subject to any disclaimer, the term of this patent is extended or adjusted under 35 U.S.C. 154(b) by 0 days.

(21) Appl. No.: 09/848,266

(22) Filed: May 4, 2001

(30) Foreign Application Priority Data

May 4, 2000 (FR) ..... 00 05727

(51) Int. Cl.[7] ..... B24B 21/00
(52) U.S. Cl. ..... 451/303; 451/302
(58) Field of Search ..... 451/49, 62, 303, 451/307, 313, 317, 318, 489

(56) References Cited

U.S. PATENT DOCUMENTS 4,993,191 A 2/1991 Judge et al.
5,058,325 A * 10/1991 Pineau ..... 51/154
5,522,762 A * 6/1996 Pineau ..... 451/163
5,651,719 A * 7/1997 Pineau ..... 451/8
5,683,291 A * 11/1997 Humpert et al. ..... 451/168
5,984,767 A * 11/1999 Pineau et al. ..... 451/302

FOREIGN PATENT DOCUMENTS

FR 2 719 516 11/1995
FR 2 758 756 7/1998

* cited by examiner

*Primary Examiner*—Timothy V. Eley
*Assistant Examiner*—Dung Van Nguyen
(74) *Attorney, Agent, or Firm*—Young & Thompson

(57) ABSTRACT

A machine for grinding cylindrical bearing surfaces on parts, in particular journals and/or crank pins on crankshafts, using an abrasive belt, includes a support on which three abrasive belt clamping members are mounted in a triangle and mobile in directions that converge toward the axis of the bearing surface to be ground. Each clamping member carries at least one applicator shoe conformed to press the abrasive belt against the bearing surface along a surface essentially limited to a generatrix parallel to the axis of the bearing surface. The shoe is preferably made from an elastomer having a Shore hardness at most equal to 100 and has a cylindrically curved applicator surface with a radius of curvature less than the radius of curvature of the bearing surface.

13 Claims, 3 Drawing Sheets

MACHINE FOR GRINDING CYLINDRICAL BEARING SURFACES ON PARTS USING AN ABRASIVE BELT

BACKGROUND OF THE INVENTION

1. Field of the Invention

The present invention relates to a machine for grinding cylindrical bearing surfaces on parts, in particular journals and crank pins on crankshafts, using an abrasive belt, the machine including a support on which three abrasive belt clamping members are mounted in a triangle so that they can move in directions that intersect on the axis of the bearing surface to be ground.

2. Description of the Prior Art

Superfinishing machines of the above type are known in the art, for example from the documents FR-A-2 634 877, U.S. Pat. No. 5,522,762 and U.S. Pat. No. 5,651,719. As described in the above documents, the abrasive belt clamping members carry abrasive belt applicator shoes in the form of jaws which can be very hard and subtend a larger or smaller circumferential angle, which in particular makes it possible to correct any shape defects caused by preceding grinding operations. On the other hand, the clamping members with their dedicated applicator shoes are designed for a very specific diameter, which means that a machine equipped with these clamping members can be used only to grind specific parts, for example crankshafts of one design of engine. However, for reasons of flexibility, it would be desirable to be able to use the same machine to grind crankshafts for several designs of the same type of engine, for example, or even crankshafts for different types of engine, in particular engines in which the journals and/or crank pins may have different diameters.

The problem stated above in connection with the diameter of the bearing surfaces to be ground can also arise in connection with the width of the bearing surfaces.

What is more, the prior art machines are not entirely satisfactory for grinding bearing surfaces of cast iron crankshafts because the applicator shoes used in these machines are not able to detach graphite nodules from the bearing surfaces because of their hardness and their circumferential angles of contact with the bearing surfaces.

The present invention relates to an abrasive belt grinding machine that is distinguished by a very high degree of flexibility in relation to the diameter of the bearing surfaces that can be ground using the same abrasive belt clamping members. The invention also relates to an abrasive belt grinding machine that is distinguished by a very high degree of flexibility in relation to the width of the bearing surfaces that can be ground using the same abrasive belt clamping members and the same abrasive belts. The invention also relates to an abrasive belt grinding machine which is distinguished by improved efficiency in grinding cast iron crankshaft bearing surfaces.

SUMMARY OF THE INVENTION

The invention provides a machine for grinding cylindrical bearing surfaces on parts, in particular journals and/or crank pins on crankshafts, using an abrasive belt, including three abrasive belt clamping members mounted in a triangle and mobile in directions that converge toward the axis of the bearing surface to be ground, wherein each clamping member carries at least one applicator shoe conformed to press the abrasive belt against the bearing surface along a surface essentially limited to a generatrix parallel to the axis of the bearing surface.

The shoe can advantageously have a cylindrically curved applicator surface, preferably with a radius of curvature less than the radius of curvature of the bearing surface and more particularly less than half the radius of curvature of the bearing surface.

Each abrasive belt clamping member can advantageously carry two applicator shoes spaced in the circumferential direction, preferably by a distance that substantially corresponds to the distance between the successive shoes of two consecutive clamping members, for the average of the extreme diameters of bearing surfaces that can be ground on the same machine.

Each shoe is preferably made of a material such as an elastomer having a Shore hardness less than or equal to 100.

If the bearing surface has been rough-ground with a curvature that must be conserved on superfinishing, it is possible for each abrasive belt applicator shoe to have, along the axis of the bearing surface to be ground, two end parts of higher hardness on respective opposite sides of an intermediate part of lower hardness. For example, the end parts can have a Shore hardness of the order of 95 and the intermediary part a Shore hardness of the order of 65.

To be able to machine bearing surfaces with different widths on the same machine without having to change the abrasive belt, the clamping members and the applicator shoes mounted on those members, it is advantageous to make the length of the shoes and the width of the abrasive belt less than the width of the narrowest bearing surface and to cause the support on which the abrasive belt clamping members are mounted to oscillate at a low speed during the grinding of the bearing surface and over a greater or lesser stroke, which is manifested in the form of a tacking movement of the abrasive belt relative to the bearing surface of the part which is driven in rotation in the usual way. This tacking movement imparted to the abrasive belt is independent of the oscillatory movement at high speed and over a relatively small stroke usually imparted to the part during superfinishing.

One illustrative and non-limiting embodiment of a grinding machine according to the invention is described in more detail hereinafter with reference to the appended drawings.

DETAILED DESCRIPTION OF THE PREFERRED EMBODIMENTS

Figure 1:
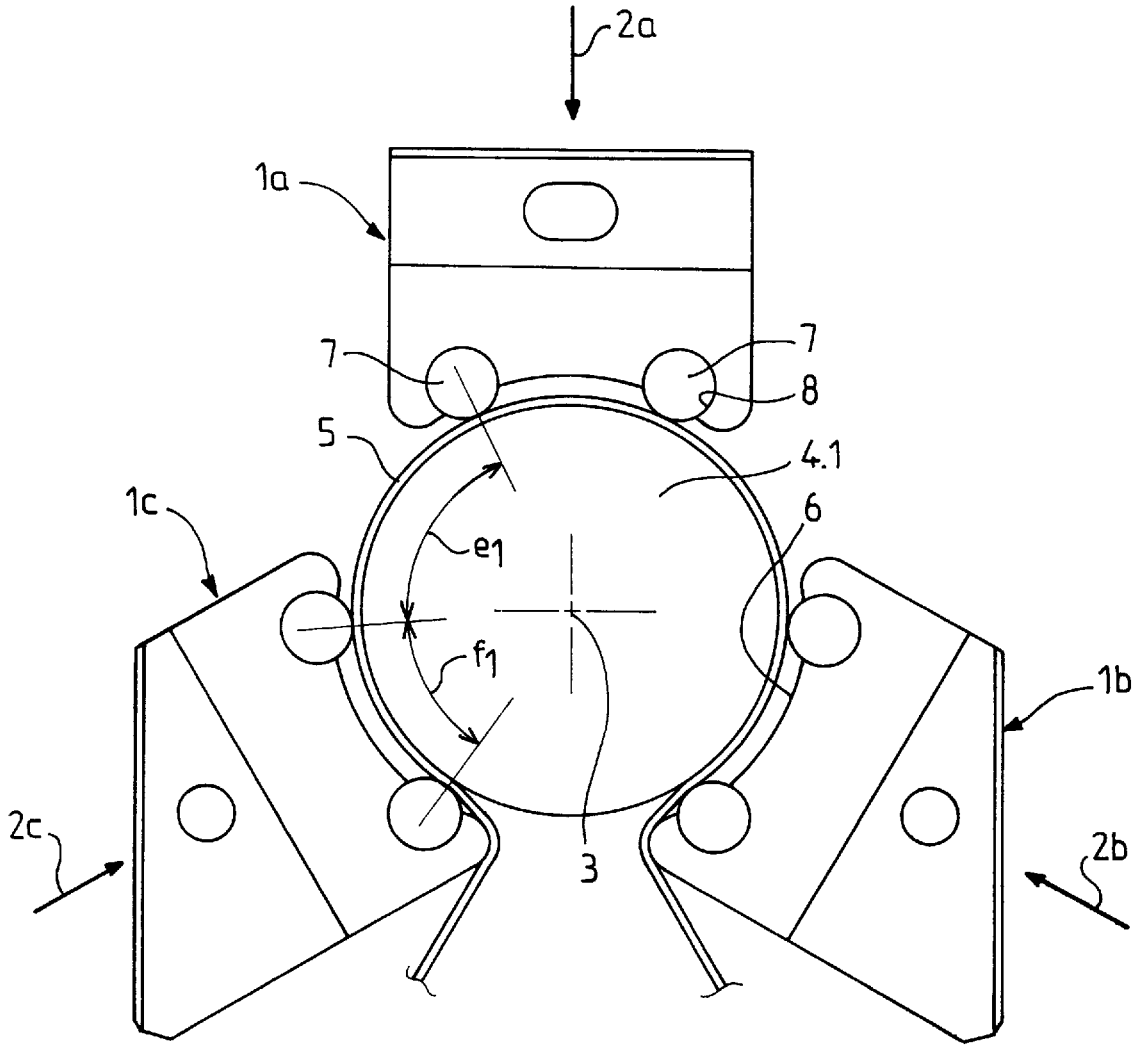
FIG. 1 is a diagram showing the three abrasive belt clamping members, each with two applicator shoes, in a position for grinding a large-diameter bearing surface.

FIG. 1 shows three clamping members 1*a,* 1*b* and 1*c* mounted in a manner that is known in the art in a triangle on a support, not shown, for example an arm of a machine for superfinishing journals and/or crank pins of crankshafts, being mobile in directions (shown by the arrows 2*a,* 2*b* and 2*c*) converging on the axis 3 of a cylindrical bearing surface 4.1 to be ground. Machines of this kind for superfinishing using an abrasive belt 5 are well known in the art, for example from the prior art documents already mentioned, insofar as the general structure and mode of operation are concerned, and there is therefore no need to describe them in more detail in this application.

The surface 6 of each clamping member 1 facing toward the bearing surface 4.1 to be ground carries two shoes 7 parallel to the axis 3, each consisting of a cylindrical round member whose axis is parallel to the axis 3 of the bearing surface and whose diameter is less than the diameter of the bearing surface 4.1. The two shoes 7 of each member 1 are spaced from each other in the circumferential direction by an angular distance e1 slightly greater than the angular distance f1 between the two consecutive shoes of two successive members 1 whose shoes 7 press the abrasive belt 5 against the bearing surface 4.1.

Note that each shoe 7 fastened to the member 1 is in this example force-fitted into a housing 8 consisting of a hole formed in the member 1 so that a cylindrical segment of the shoe 7 subtending an angle of 120°, for example, projects from the surface 6 of the member 1.

Each shoe 7 is advantageously made from a material having a Shore hardness of less than 100, for example an elastomer such as the COURBHANE elastomer from COURBIS SYNTHESE, F-26100 ROMANS SUR ISERE.

The diameter of the shoes 7 is chosen as a function of the diameter of the bearing surfaces 4 to be ground so that the shoes are in contact with the bearing surface, through the abrasive belt 5, along contact surfaces which are limited more or less to generatrices of the bearing surface.

Given the limited hardness of the material of the shoes and the shape of the shoes, because of which the contact of the belt with the bearing surface at the location of each shoe is essentially limited to a generatrix of the bearing surface, the shoes enable the abrasive belt 5 to "penetrate" into the material of the bearing surface and, in the case of cast iron crankshaft bearing surfaces, detach graphite nodules from the bearing surface.

Figure 2:
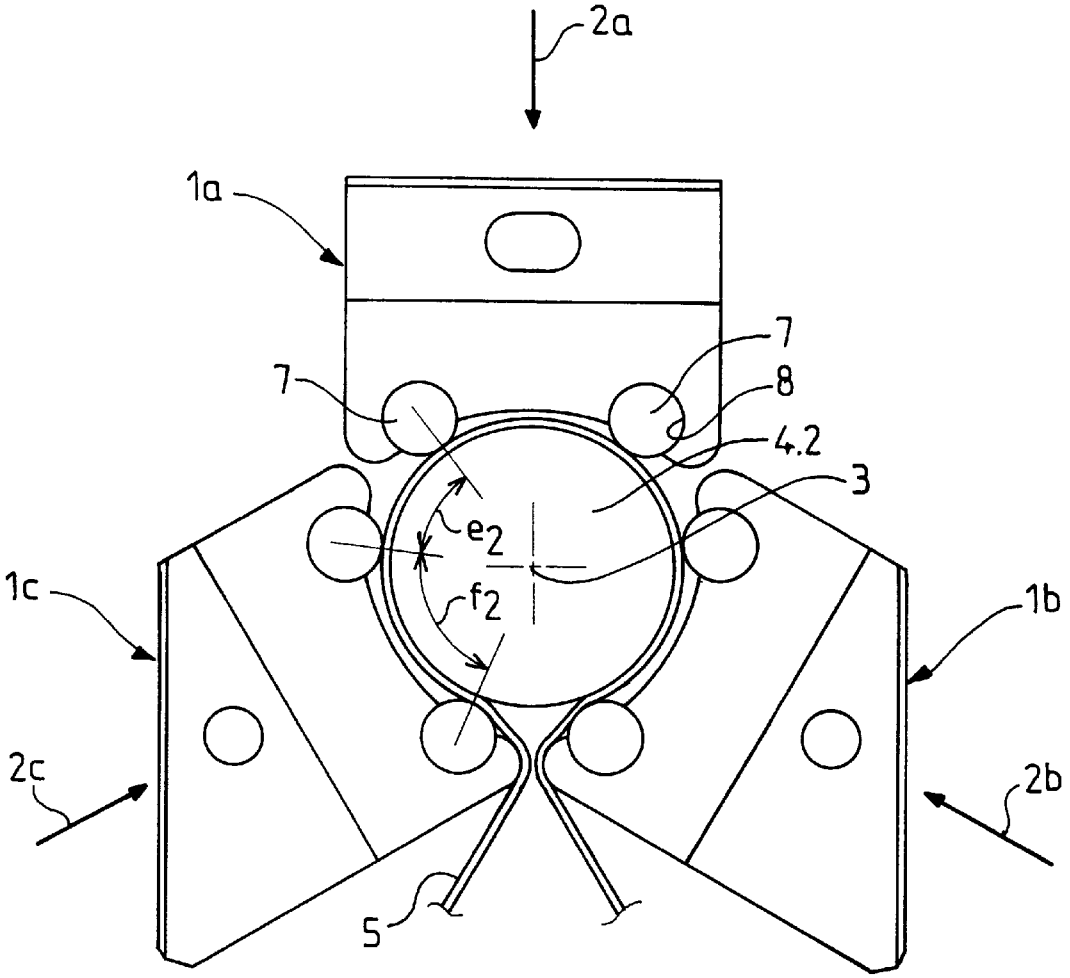
FIG. 2 shows the same three members in a position for grinding a small-diameter bearing surface.

Because each clamping member 1 carries two shoes 7 with a cylindrical applicator surface whose diameter is small compared to the diameter of the bearing surfaces to be ground, it is possible to grind bearing surfaces 4 with different diameters using the same clamping members 1 carrying the same shoes 7, as is apparent on comparing FIG. 1 with FIG. 2, in which it can be seen that the diameter of the bearing surface 4.2 to be ground is significantly less than the diameter of the bearing surface 4.1 shown in FIG. 1.

In FIG. 2, the angular distance e2 between two consecutive shoes 7 of two successive members 1 is less than the angular distance f2 between the two shoes 7 of the same member 1 in contact with the bearing surface 4.2.

The distance f on each member 1 is preferably chosen to correspond substantially to the distance e for the average of the extreme diameters of the bearing surfaces 4 that can be ground on the same machine with the same clamping members 1 equipped with the same shoes 7.

Figure 3:
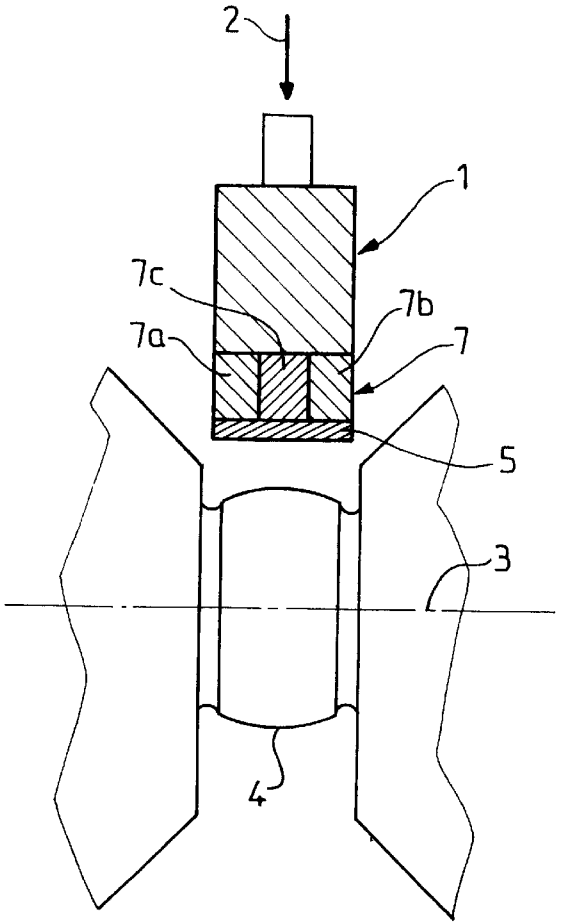
FIG. 3 shows a clamping member with a shoe with axially graded hardness for grinding a curved bearing surface.

Referring to FIG. 3, a bearing surface 4 that has been rough-ground with a curvature (shown exaggerated here) must conserve that curvature during superfinishing by the abrasive belt 5. For this reason, the shoes 7 of the clamping members 1 (only one of which is shown) are each made up of several parts of different hardness in succession along the axis 3 of the bearing surface 4, namely, in this example, two end parts 7*a*, 7*b* of higher hardness and an intermediate part 7*c* of lower hardness. Accordingly, although the three parts 7*a*, 7*b* and 7*c* have the same section, the less hard intermediate part 7*c* presses the abrasive belt 5 against the maximum-diameter middle part of the bearing surface 4 with a pressure that is substantially equal to the pressure with which the abrasive belt 5 is pressed against the smaller-diameter end parts of the bearing surface, so that the curvature of the bearing surface is not degraded by the superfinishing operation.

Figure 4:
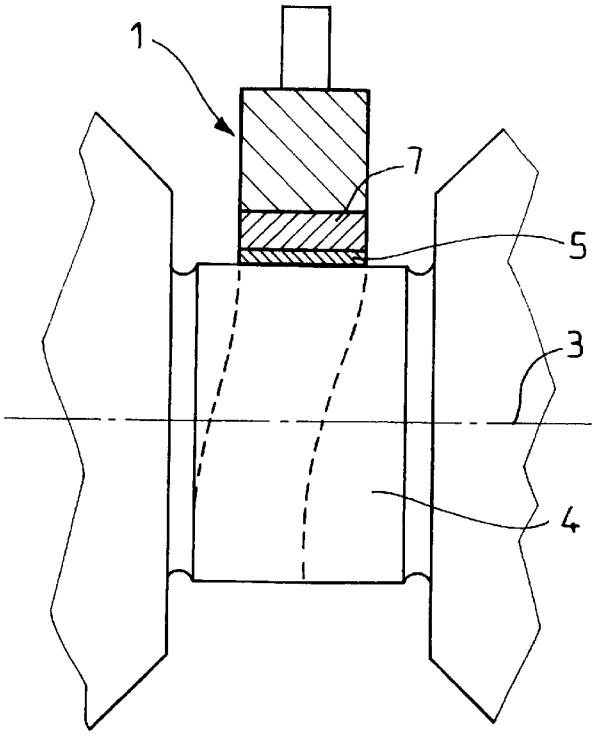
FIG. 4 shows a clamping member with a shoe and an abrasive belt of reduced width and the tacking movement of the belt relative to the bearing surface.

Referring to FIG. 4, a bearing surface 4 is ground by means of an abrasive belt 5 and clamping members 1 with shoes 7 (only one of which is shown) having a width less than the width of the bearing surface 4. To machine the bearing surface 4 uniformly, the clamping members 1, or rather their support, not shown, is caused to oscillate in the direction of the axis 3 of the bearing surface 4 at a low speed so that the belt 5 effects a tacking movement relative to the bearing surface 4 which is driven in rotation about its axis 3, that movement being symbolized in dashed outline in FIG. 4, and having an amplitude such that the entire width of the bearing surface is ground.

It should be noted that the machine according to the invention, instead of including two shoes 7 in the form of round members on each of the three clamping members 1 participating in the grinding of a bearing surface 4, could equally well be equipped, for example, with a single shoe 7 on each clamping member 1, although this would reduce to three the number of generatrices of contact of the abrasive belt 5 with the bearing surface 4. It would equally be possible to provide three shoes 7 on each clamping member 1, which would increase the number of generatrices of contact of the belt 5 with the bearing surface 4, but would eliminate the flexibility of the machine, i.e. the facility to adapt it to bearing surfaces with different diameters without modifying the clamping members 1 and the shoes 7. Furthermore, there is in theory nothing to oppose replacing the shoes 7 in the form of round members on the three clamping members 1, bringing about "linear" contact along generatrices, with shoes in the form of jaws, having an applicator surface conformed for a bearing surface of particular diameter, although this would also be to the detriment of the flexibility of the machine.

There is claimed:

1. A machine for superfinishing an at least substantially cylindrical bearing surface having an axis of rotation on a workpiece, comprising an abrasive belt and three abrasive belt clamping members mounted in a triangle around said bearing surface and movable in directions that converge on the axis of rotation of said bearing surface, wherein each of said three clamping members has a surface facing said bearing surface and carries two applicator shoes rigidly fastened to the clamping member so as to project from said clamping member surface toward said bearing surface, said two shoes being spaced from each other in the circumferential direction of said bearing surface, each of the six shoes thus provided having a cylindrically curved abrasive belt applicator surface to press said abrasive belt against said bearing surface along a surface substantially limited to a generatrix parallel to said axis of said bearing surface.

2. The machine claimed in claim 1, wherein the radius of curvature of said applicator surface is less than the radius of curvature of said bearing surface.

3. The machine claimed in claim 2, wherein the radius of curvature of said applicator surface is less than half the radius of curvature of said bearing surface.

4. The machine claimed in claim 1, wherein the distance between said two shoes of each clamping member substantially corresponds to the distance between the successive shoes of two consecutive clamping members.

5. The machine claimed in claim 1, wherein each shoe is made of an elastomer having a Shore hardness less than or equal to 100.

6. The machine claimed in claim 1, wherein each shoe has a graded hardness along said axis of said bearing surface to be ground.

7. The machine claimed in claim 6, wherein each shoe has, along the axis of the bearing surface to be ground, two end parts of higher hardness on respective opposite sides of an intermediate part of lower hardness.

8. The machine claimed in claim 1, wherein the length of said shoes and the width of said abrasive belt are less than the width of said bearing surface to be ground and, during grinding, said clamping members perform an oscillatory movement along said axis of said bearing surface to be ground at a low speed and with a stroke such that said abrasive belt executes a tacking movement relative to said bearing surface which is driven in rotation about its axis to grind the entire width of said bearing surface.

9. A machine for superfinishing an at least substantially cylindrical bearing surface having an axis of rotation on a cast iron crankshaft, comprising an abrasive belt and three abrasive belt clamping members mounted in a triangle and movable in directions that converge on the axis of rotation of the bearing surface to be superfinished, wherein each clamping member has a surface facing said bearing surface and carries two applicator shoes made from an elastomer having a Shore hardness of not more than 100, rigidly fastened to the clamping member so as to project from said clamping member surface toward said bearing surface, said two shoes being spaced from each other in the circumferential direction of said bearing surface, each of the six shoes thus provided having a cylindrically curved abrasive belt applicator surface, the radius of curvature of said applicator surface being less than half the radius of curvature of said bearing surface, to press said abrasive belt against said bearing surface along a surface substantially limited to a generatrix parallel to said axis of said bearing surface.

10. The machine claimed in claim 9, wherein the distance between said two shoes of each clamping member substantially corresponds to the distance between the successive shoes of two consecutive clamping members.

11. The machine claimed in claim 9, wherein each shoe has a graded hardness along said axis of said bearing surface to be ground.

12. The machine claimed in claim 11, wherein each shoe has, along the axis of the bearing surface to be ground, two end parts of higher hardness on respective opposite sides of an intermediate part of lower hardness.

13. The machine claimed in claim 9, wherein the length of said shoes and the width of said abrasive belt are less than the width of said bearing surface to be ground and, during grinding, said clamping members perform an oscillatory movement along said axis of said bearing surface to be ground at a low speed and with a stroke such that said abrasive belt executes a tacking movement relative to said bearing surface which is driven in rotation about its axis to grind the entire width of said bearing surface.

* * * * *